US008454328B2

(12) United States Patent
Kotlyar et al.

(10) Patent No.: US 8,454,328 B2
(45) Date of Patent: Jun. 4, 2013

(54) MULTIPLEX RECIPROCATING PUMP

(75) Inventors: Taya Kotlyar, Warwick, PA (US); Joel E. Higbee, Horsham, PA (US); Robert Bean, Spring City, PA (US); Alex Kotlyar, Warwick, PA (US)

(73) Assignee: Milton Roy Company, Ivyland, PA (US)

( * ) Notice: Subject to any disclaimer, the term of this patent is extended or adjusted under 35 U.S.C. 154(b) by 682 days.

(21) Appl. No.: 12/352,041

(22) Filed: Jan. 12, 2009

(65) Prior Publication Data

US 2010/0178179 A1 Jul. 15, 2010

(51) Int. Cl.
*F04B 17/00* (2006.01)

(52) U.S. Cl.
USPC ..... 417/415

(58) Field of Classification Search
USPC ..... 417/415–419
See application file for complete search history.

(56) References Cited

U.S. PATENT DOCUMENTS 3,636,570 A * 1/1972 Nielson ..... 623/3.24
3,674,049 A * 7/1972 Macgregor ..... 137/355.2
3,739,943 A * 6/1973 Wilhelmson et al. ..... 222/59
4,358,969 A * 11/1982 Silvestri ..... 475/31
4,818,845 A * 4/1989 Koizumi et al. ..... 392/462
5,807,333 A * 9/1998 Osborne et al. ..... 604/131
6,079,959 A * 6/2000 Kingsford et al. ..... 417/393
2004/0013538 A1* 1/2004 Fuchs ..... 417/295
2007/0169619 A1* 7/2007 Smith ..... 91/493

FOREIGN PATENT DOCUMENTS

KR 100789398 B1 * 12/2007

OTHER PUBLICATIONS

English Translation of KR 1000789398 B1 (Dec. 2007).*

* cited by examiner

*Primary Examiner* — Anh Mai
*Assistant Examiner* — Hana Featherly
(74) *Attorney, Agent, or Firm* — Stephen G. Mican

(57) ABSTRACT

A reciprocating pump assembly comprises: a motor with a rotary motor drive shaft; a cam coupled to the motor drive shaft with an axis of rotation and a cam channel cut generally axially into a radial face of the cam; and multiple reciprocating pump units arranged radially about the cam axis of rotation, each with an inlet valve, an outlet valve, a plunger and a plunger sleeve, with a free end of its plunger coupled to the cam by way of a cam follower riding in the cam channel; wherein rotation of the motor output drive shaft causes the plunger in each pump unit to independently reciprocate in its respective sleeve.

23 Claims, 8 Drawing Sheets

MULTIPLEX RECIPROCATING PUMP

FIELD OF THE INVENTION

The invention relates to reciprocating pumps, and more particularly to motor powered reciprocating pumps for developing high pressure.

BACKGROUND OF THE INVENTION

Reciprocating injection pumps are useful for developing precisely metered quantities of flow at high pressures, particularly in the oil and gas, and the chemical industries. It is desirable to improve the efficiency of such pumps so that they may be operable by means of low power electrical sources, such as by means of a dedicated solar panel.

However, to date the electro-mechanical efficiency of electrically-driven reciprocal injection pumps has made their operation from low power electrical sources such as dedicated solar panels impractical. The motor is generally an alternating current (AC) single phase induction motor that has a typical efficiency of about 30 percent. The normal rotational speed of the motor generally requires some degree of speed reduction to be compatible with the speed of the pump plunger, such as by means of worm gearing. The rotary motion of the motor also requires conversion to reciprocal motion, such as by means of an eccentric and connecting rod, a cam and spring-loaded cam follower that follows the annular outer face of the cam, or a similar arrangement to drive the pump plunger. Such mechanical coupling arrangements add to the conversion inefficiency of the pumping system.

SUMMARY OF THE INVENTION

The invention generally comprises a reciprocating pump assembly that comprises: a motor with a rotary motor drive shaft; and a cam coupled to the motor drive shaft with an axis of rotation and a cam channel cut generally axially into a radial face of the cam; multiple reciprocating pump units arranged radially about the cam axis of rotation, each with an inlet valve, an outlet valve, a plunger and a plunger sleeve, with a free end of its plunger coupled to the cam by way of a cam follower riding in the cam channel; wherein rotation of the motor output drive shaft causes the plunger in each pump unit to independently reciprocate in its respective sleeve.

DETAILED DESCRIPTION OF THE INVENTION

Figure 1:
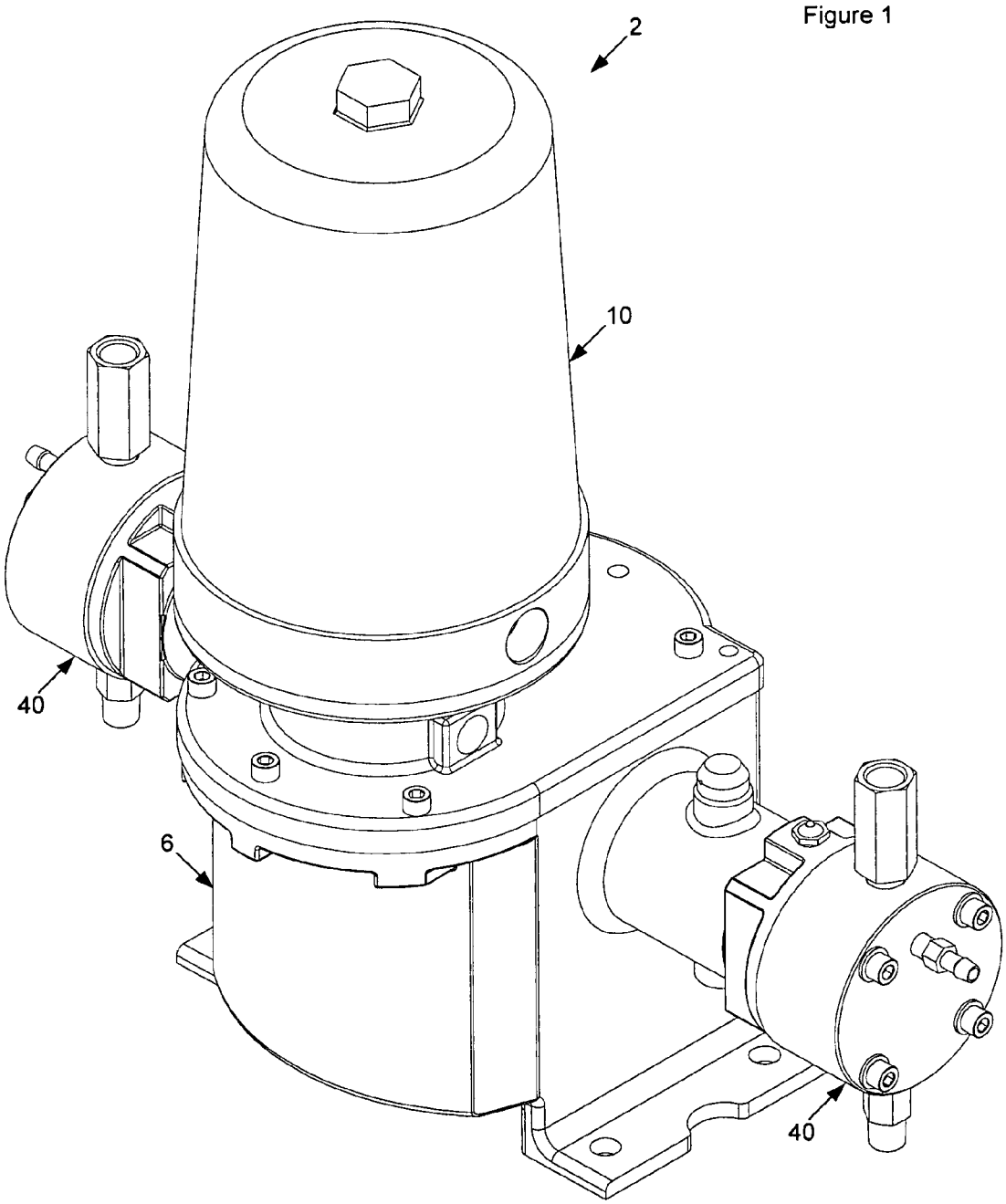
FIG. 1 is an isometric view of a pump assembly according to at least one possible embodiment of the invention.
Figure 2:
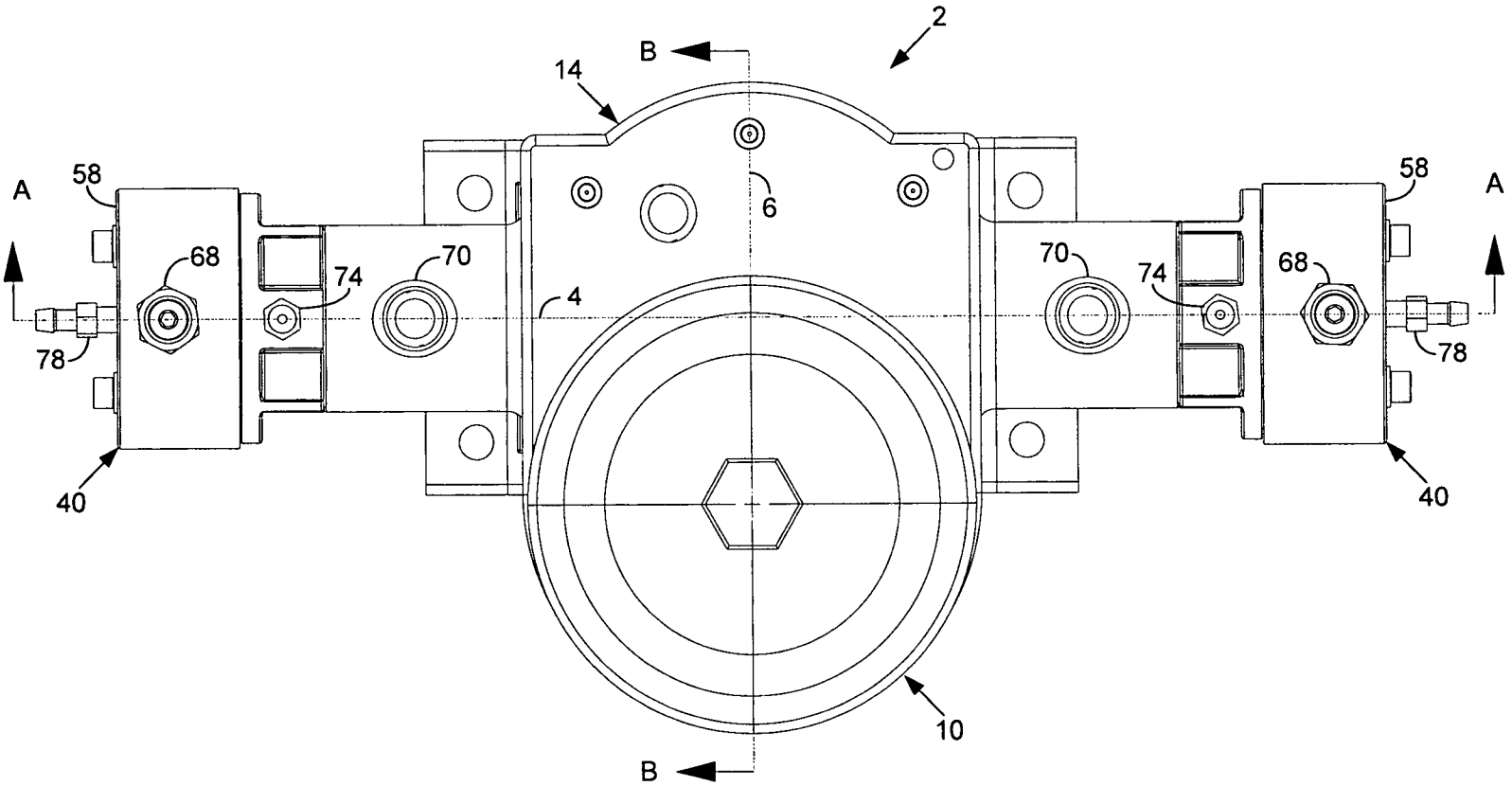
FIG. 2 is a top view of the pump assembly shown in FIG. 1.

FIG. 1 is an isometric view of a pump assembly 2 according to at least one possible embodiment of the invention. FIG. 2 is a top view of the pump assembly 2 shown in FIG. 1.

Figure 3:
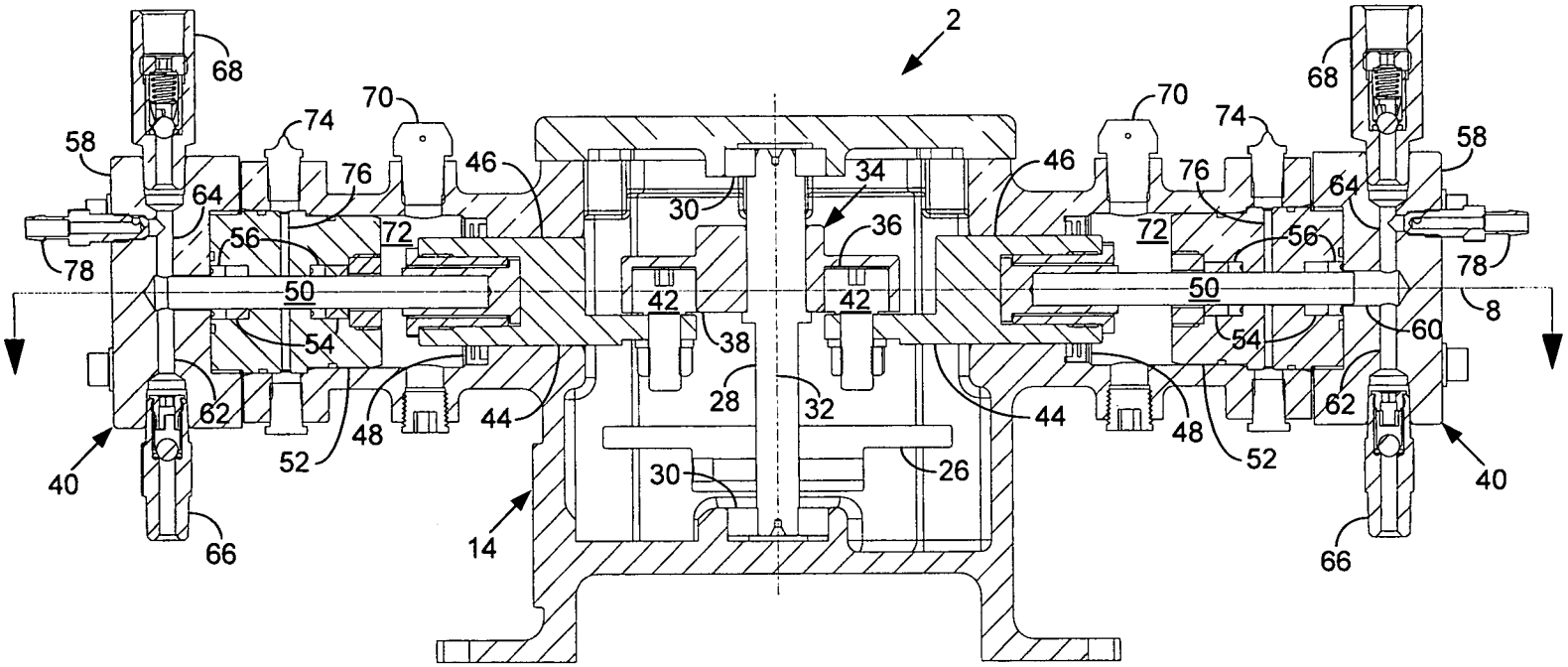
FIG. 3 is a cross-sectional front view of the pump assembly shown in FIG. 2 according to one possible embodiment of the invention.
Figure 4:
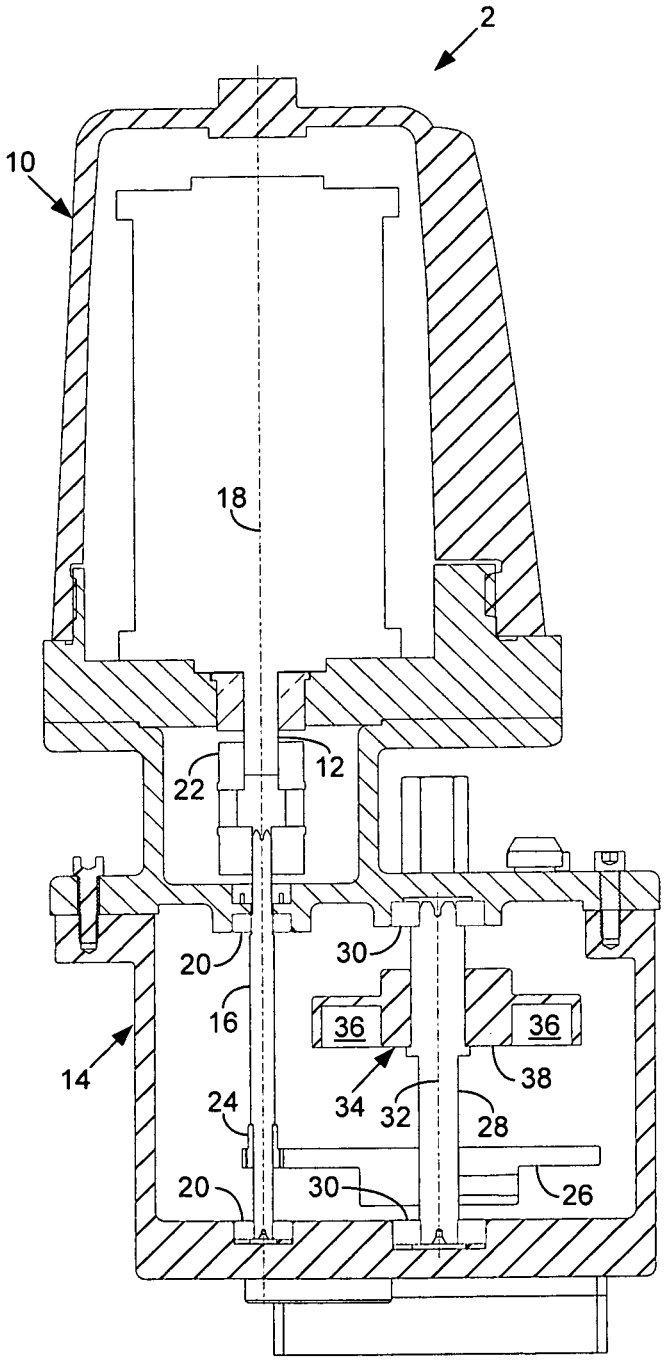
FIG. 4 is a cross-sectional side view of the pump assembly shown in FIGS. 2 and 3 according to one possible embodiment of the invention.
Figure 5:
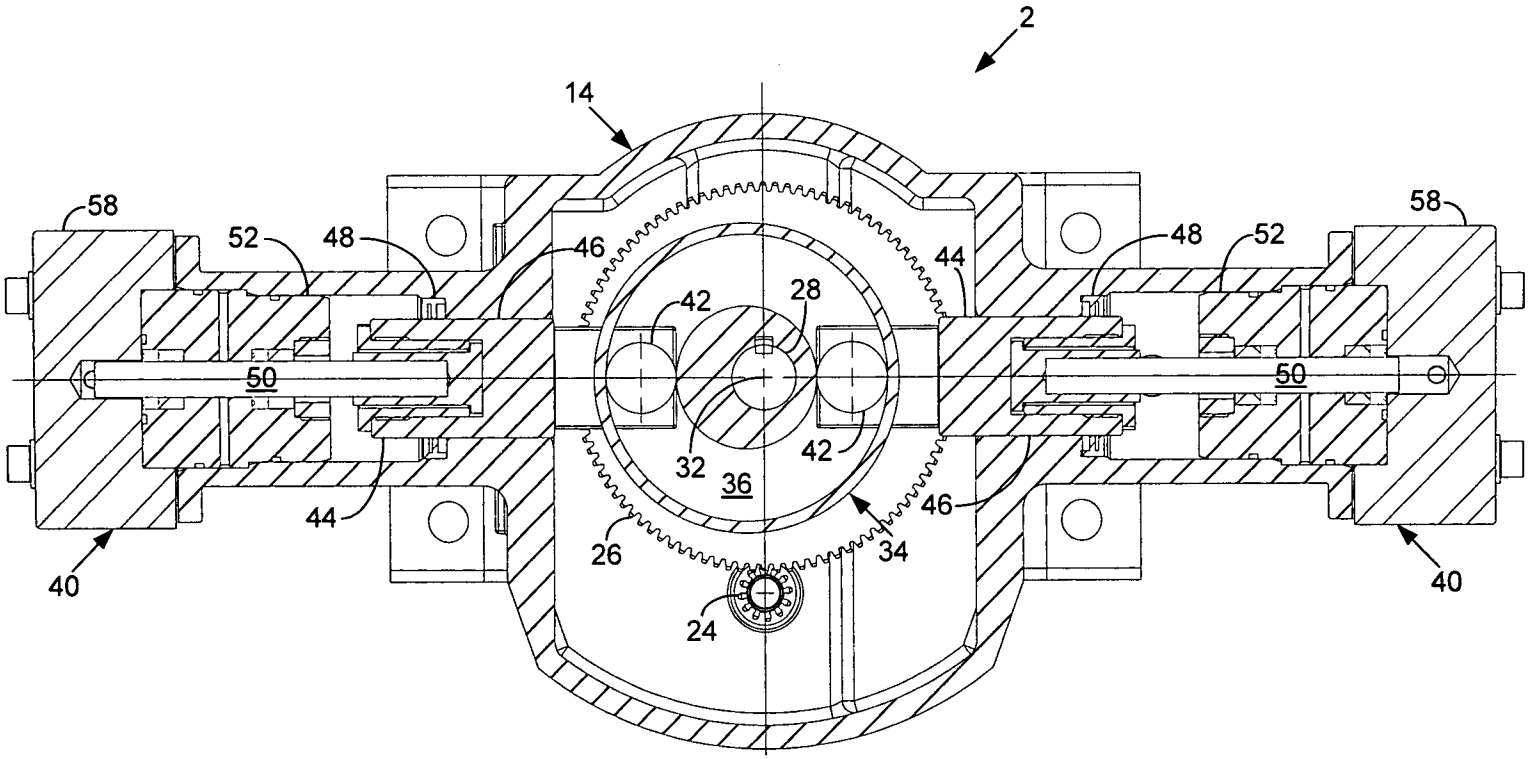
FIG. 5 is a cross-sectional top view of the pump assembly shown in FIG. 3 according to one possible embodiment of the invention.

FIG. 3 is a cross-sectional front view of the pump assembly 2 along a cross-sectional line 4 shown in FIG. 2 according to a first possible embodiment of the invention. FIG. 4 is a cross-sectional side view of the pump assembly 2 shown in FIG. 2 according to a first possible embodiment of the invention along a cross-sectional line 6. FIG. 5 is a cross-sectional top view of the pump assembly 2 along a cross-sectional line 8 shown in FIG. 3. Referring to FIGS. 1 through 5 together, the pump assembly 2 according to this embodiment of the invention has a motor 10, such as an electric motor, with a motor output shaft 12. The motor 10 couples to a housing 14 of the pump assembly 2. The pump assembly 2 has an input shaft 16 with a rotational freedom of movement about an input shaft axis 18 by means of input shaft bearings 20 that retain the input shaft 16 and mount to the housing 14. One end of the input shaft 16 may couple to the motor 10 by means of a motor coupling 22.

A pinion 24 mounts on the input shaft 16 so that the pinion 24 may have an axis of rotation coincident with the input shaft axis 18. A spur gear 26 that engages the pinion 24 mounts on a main shaft 28 by means of main shaft bearings 30 that mount to the housing 12 and retain the main shaft 28 with a rotational freedom of movement about a main shaft axis of rotation 32. A pulseless cam 34 also mounts on the main shaft 28. The cam 34 may have an axis of rotation that is coincident with the main shaft axis 32. The cam 34 has a cam channel 36 cut generally axially into a radial cam face 38 of the cam 34. The path of the cam channel 36 about the radial cam face 38 is generally eccentric relative to the main shaft axis 32.

The pump assembly 2 has multiple pump units 40 that have a generally radial arrangement about the cam axis of rotation that is coincident with the main shaft axis 32. FIGS. 1 through 5 illustrate two of the pump units 40 in an opposed arrangement with 180 degrees of separation by way of illustration only. The pump assembly 2 may have three or more pump units 40, such as three pump units 40 arranged with 120 degrees of separation, four pump units 40 with 90 degrees of separation, and so forth.

Each pump unit 40 has a cam follower 42 that rides in the cam channel 36 of the cam 34. Each cam follower 42 couples to a cross head 44 for its respective pump unit 40. The cross head 44 for each pump unit 40 slides in a respective cross head channel 46 to allow the cross head 44 to move in a reciprocating lineal motion within its cross head channel 46 as its respective cam follower 42 rides in the cam channel 36 of the rotating cam 34. The lineal reciprocation motion is generally radial to the axis of rotation of the cam 34 represented by the main shaft axis 32. Each cross head channel 46 may have a cross head seal 48 to reduce seepage through its interface with its respective cross head 44.

Each pump unit 40 has a piston or plunger 50 that slides in a respective plunger cylinder or sleeve 52 to allow linear reciprocating movement of the plunger 50 within the sleeve 52. Preferably each plunger 50 comprises a ceramic material. Preferably each sleeve comprises stainless steel. Also preferably each sleeve 52 proximate each end has a low-friction composite TFE bearing 54 to reduce stress and mating low-friction composite TFE seal 56 to reduce seepage through its interface with its respective plunger 50.

The plunger 50 and cross head 44 in each pump unit 40 couple together to allow the plunger 50 to move in a reciprocating lineal motion within its sleeve 52 as the cam follower 42 for the cross head 44 rides in the cam channel 36 of the rotating cam 34. This lineal reciprocating motion is generally radial to the axis of rotation of the cam 34 represented by main shaft axis 32.

Each pump unit 40 has a pump head 58 that mates with the sleeve 52. The pump head has a plunger cavity 60 that receives the free end of the plunger 50. The plunger cavity 60 couples in fluidic communication with an inlet cavity 62 and an outlet cavity 64 in the pump head 58. The inlet cavity 62 has a one-way inlet valve 66 for passing fluid into the inlet cavity 62. The outlet cavity 64 has a one-way outlet valve 68 for discharging fluid from the outlet cavity 64. The inlet valve 66 preferably is a ball-type check valve that has composite TFE seats. The outlet valve 68 preferably is a spring-loaded ball-type check valve that has composite TFE seats.

Each pump unit 40 may also have a breather 70 that couples in fluidic communication with a cross head passage 72 between the cross head 44 and the plunger sleeve 52 for providing pressure relief. Each pump unit 40 may also have a grease fitting 74 that couples in fluidic communication with the plunger 50, such as by means of a lubrication cavity 76 that passes through the plunger sleeve 52, for lubricating the plunger 50. Each pump 40 may further have a bleeder 78 that couples in fluidic communication with the outlet cavity 64 for releasing fluid within the pump head 58.

As the motor 10 rotates the input shaft 14, the plunger 50 in each pump unit 40 reciprocates, sequentially causing its respective inlet valve 66 to draw fluid into its respective pump head plunger cavity 60 and its respective outlet valve 68 to discharge fluid. The eccentric path of the cam channel 34 preferably establishes a constant absolute speed for each plunger 50 to maintain a relatively constant discharge flow from its respective outlet valve 68.

The inlet valve 66 of each pump unit 40 may couple in fluidic communication by way of any ordinary inlet header (not shown). Likewise, the outlet valve 68 of each pump unit 40 may couple in fluidic communication by way of any ordinary outlet header (not shown). Coupling to the inlet valves 66 and the outlet valves 68 in such a manner smoothes the output of the pump assembly 2 so that there is no need for use of a pressure damper or fluid accumulator to smooth the fluid output of the pump assembly 2. Alternatively, if the pump assembly 2 has two or more pairs of pump units 40, each pair of pump units 40 may have its own set of inlet and outlet headers so that the pump assembly 2 may produce multiple sets of pump outputs, and each may at different pressures and flow rates.

Figure 6:
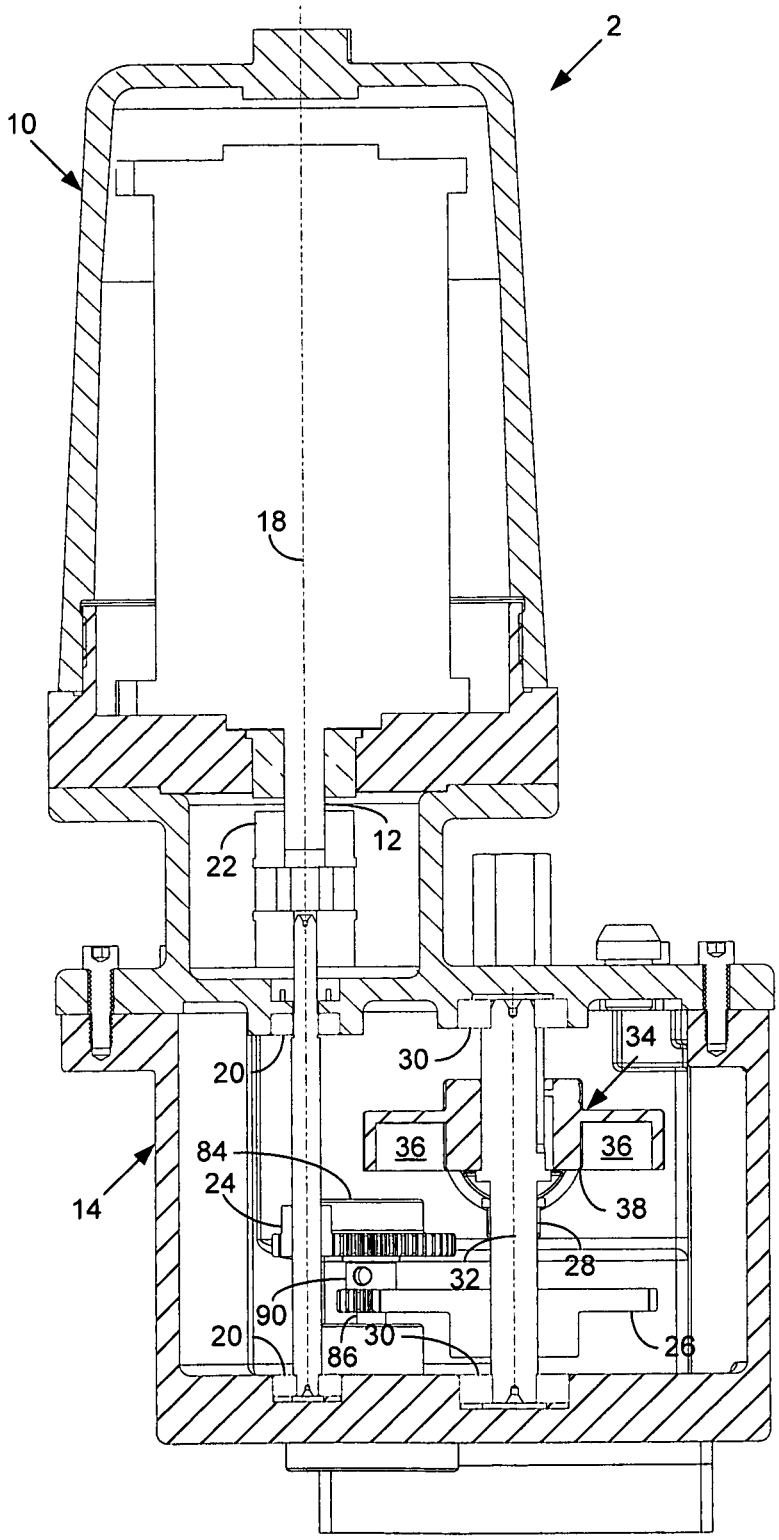
FIG. 6 is a cross-sectional side view of the pump assembly shown in FIG. 2 according to another possible embodiment of the invention.
Figure 7:
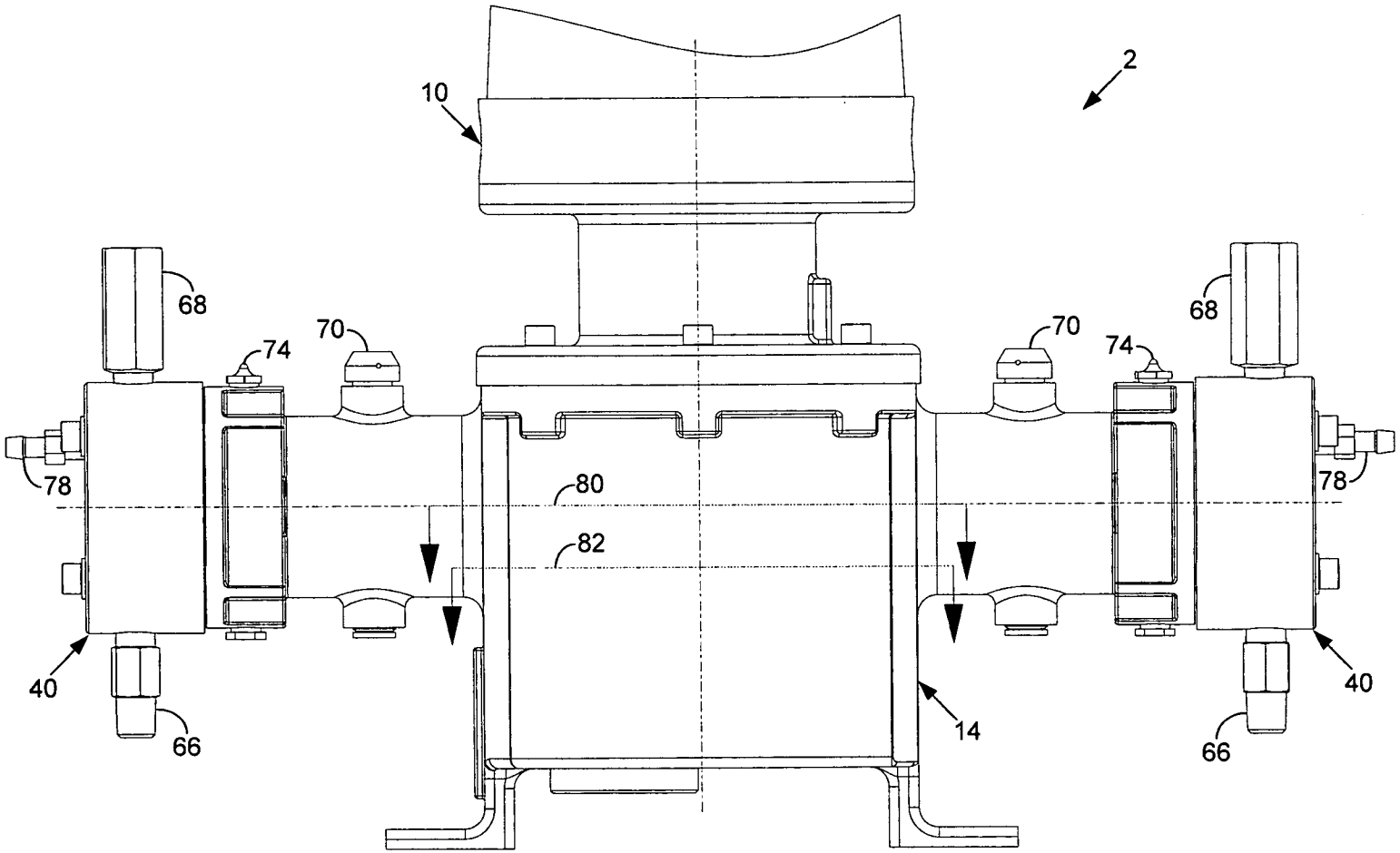
FIG. 7 is a front view of the pump assembly shown in FIG. 2 according to another possible embodiment of the invention.
Figure 8:
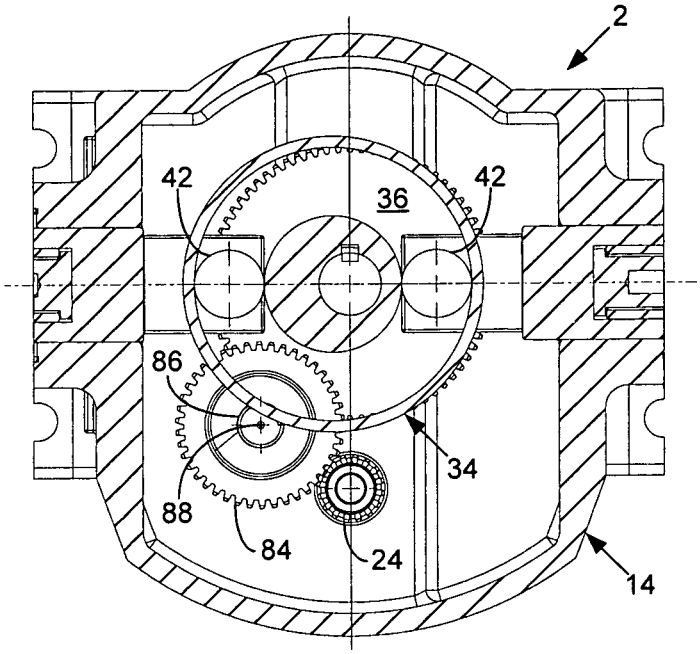
FIG. 8 is a first cross-sectional top view of the pump assembly shown in FIG. 7 according to another possible embodiment of the invention.
Figure 9:
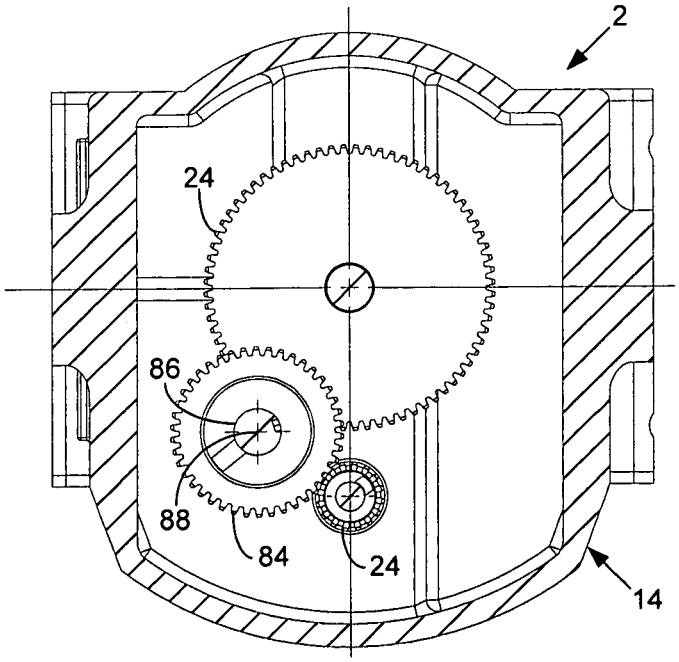
FIG. 9 is a second cross-sectional top view of the pump assembly shown in FIG. 7 according to another possible embodiment of the invention.

FIG. 6 is a cross-sectional side view of the pump assembly 2 shown in FIG. 2 according to another possible embodiment of the invention along the cross-sectional line 6. FIG. 7 is a front view of the pump assembly shown in FIG. 2 according to another possible embodiment of the invention. FIG. 8 is a first cross-sectional top view of the pump assembly shown in FIG. 7 according to another possible embodiment of the invention along a cross-sectional line 80. FIG. 9 is a second cross-sectional top view of the pump assembly 2 shown in FIG. 6 according to another possible embodiment of the invention along a cross-sectional line 82.

Referring to FIGS. 6 through 9 together, the pump assembly 2 according to this embodiment of the invention has a double-stage input spur gear 84 that mounts on an intermediate shaft 86 and engages the pinion 24. The intermediate shaft 86 has a rotational freedom of movement about an intermediate shaft axis 88 by means of intermediate shaft bearings (not shown) that retain the intermediate shaft 86 and mount to the housing 14. A double-stage output spur gear 90 also mounts on the intermediate shaft 86. The double-stage output spur gear 90 engages the spur gear 26. In this embodiment, the gear reduction established by the pinion 24 driving the double-stage input spur gear 84 and the double-stage output spur gear 90 driving the spur gear 26 provides a lower speed of operation for a given speed of the motor 10 than the possible embodiment of the invention described in connection with FIGS. 3 through 5. It is possible to achieve even further gear reduction by means of additional intermediate gear reduction stages coupled to each other in a similar manner.

In most low power applications, particularly those that employ a dedicated or self-contained source of power for the motor 10, such as a solar panel or battery, the motor 10 is preferably of the direct current (DC) type, either with or without brushes. In such service, a motor controller with a pulse width modulation (PWM) output is most desirable for regulating the speed of the motor 10. For best efficiency, it is desirable to match the torque requirement of the pump assembly 2 to the motor 10, such as by adjusting the diameter of each plunger 50 and the gear ratio of the reduction gear set between the motor drive shaft 12 and the main shaft 28.

The described embodiments of the invention are only some illustrative implementations of the invention wherein changes and substitutions of the various parts and arrangement thereof are within the scope of the invention as set forth in the attached claims.

The invention claimed is:

1. A reciprocating pump assembly that comprises:

a motor with a rotary motor drive shaft;

a cam coupled to the motor drive shaft, the cam having a circular perimeter, a cam axis of rotation and a cam channel that cuts generally axially into a radial face of the cam and has a cam channel path that is generally parallel to the perimeter of the cam and eccentric relative to the cam axis of rotation; and multiple reciprocating pump units arranged radially about the cam axis of rotation, each with an inlet valve, an outlet valve, a plunger and a plunger sleeve, with a free end of its plunger coupled to the cam by way of a cam follower riding in the cam channel along the cam channel path;

wherein rotation of the motor output drive shaft causes the plunger in each pump unit to reciprocate in its respective plunger sleeve.

2. The pump assembly of claim 1, wherein the motor comprises an electric motor.

3. The pump assembly of claim 2, wherein the electric motor comprises a direct current (DC) motor.

4. The pump assembly of claim 1, further comprising a reduction gear set for coupling the motor to the cam.

5. The pump assembly of claim 4, wherein the reduction gear set comprises a spur-type gear set.

6. The pump assembly of claim 4, wherein the reduction gear set comprises a two-stage reduction gear set.

7. The pump assembly of claim 1, wherein each plunger has a diameter and the reduction gear set has a gear reduction ratio that matches the torque requirement of the pump assembly to the motor.

8. The pump assembly of claim 1, wherein the cam channel drives each cam follower at a generally constant absolute speed.

9. The pump assembly of claim 1, wherein each plunger comprises a ceramic material.

10. The pump assembly of claim 1, wherein each plunger sleeve comprises stainless steel.

11. The pump assembly of claim 1, wherein each plunger sleeve comprises composite TFE bearings.

12. The pump assembly of claim 1, wherein each plunger sleeve comprises composite TFE seals.

13. The pump assembly of claim 1, wherein each inlet valve comprises a ball-type check valve.

14. The pump assembly of claim 13, wherein each inlet valve comprises composite TFE seats.

15. The pump assembly of claim 1, wherein each outlet valve comprises a spring-loaded ball-type check valve.

16. The pump assembly of claim 1, wherein each outlet valve comprises composite TFE seats.

17. A reciprocating pump assembly that comprises:

an electric motor with a rotary motor drive shaft;

a cam that has a circular perimeter, a cam axis of rotation and a cam channel that cuts generally axially into a radial face of the cam and has a cam channel path that is generally parallel to the perimeter of the cam and eccentric relative to the cam axis of rotation;

a gear reduction set that couples the motor drive shaft to the cam; and multiple reciprocating pump units arranged radially about the cam axis of rotation, each with an inlet valve, an outlet valve, a ceramic plunger and a stainless steel plunger sleeve, with a free end of its plunger coupled to the cam by way of a cam follower riding in the cam channel along the cam channel path;

wherein rotation of the motor output drive shaft causes the plunger in each pump unit to reciprocate in its respective plunger sleeve at a generally constant absolute speed.

18. The pump assembly of claim 17, wherein each plunger has a diameter and the reduction gear set has a gear reduction ratio that matches the torque requirement of the pump assembly to the motor.

19. The pump assembly of claim 17, wherein each plunger sleeve comprises composite TFE bearings and seals.

20. The pump assembly of claim 17, wherein each inlet valve comprises a ball-type check valve with composite TFE seats and each outlet valve comprises a spring-loaded ball-type check valve with composite TFE seats.

21. A reciprocating pump assembly that comprises:

an electric direct current (DC) motor with a rotary motor drive shaft;

a cam that has a circular perimeter, a cam axis of rotation and a cam channel that cuts generally axially into a radial face of the cam and has a cam channel path that is generally parallel to the perimeter of the cam and eccentric relative to the cam axis of rotation;

a gear reduction set that couples the motor drive shaft to the cam; and two reciprocating pump units arranged in a radially opposed configuration about the cam axis of rotation, each with a ball-type inlet valve, a spring-loaded ball-type outlet valve, a ceramic plunger and a stainless steel plunger sleeve, with a free end of its plunger coupled to the cam by way of a cam follower riding in the cam channel along the cam channel path;

wherein rotation of the motor output drive shaft causes the plunger in each pump unit to reciprocate in its respective plunger sleeve at a generally constant absolute speed.

22. The pump assembly of claim 21, wherein each plunger has a diameter and the reduction gear set has a gear reduction ratio that matches the torque requirement of the pump assembly to the motor.

23. The pump assembly of claim 21, wherein each plunger sleeve comprises composite TFE bearings, each inlet valve comprises composite TFE seats and each outlet valve comprises composite TFE seats.

* * * * *